US006026824A

United States Patent [19]

Gueret

[11] Patent Number: 6,026,824

[45] Date of Patent: Feb. 22, 2000

[54] DEVICE FOR APPLYING A MAKE-UP PRODUCT FOR KERATINOUS FIBERS, IN PARTICULAR EYELASHES, AND A PACKAGING AND APPLICATION UNIT USING SUCH A DEVICE

[75] Inventor: Jean-Louis H. Gueret, Paris, France

[73] Assignee: L'Oreal, Paris, France

[21] Appl. No.: 09/027,186

[22] Filed: Feb. 20, 1998

[30] Foreign Application Priority Data

Feb. 21, 1997 [FR] France ..... 97 02109

[51] Int. Cl.[7] ..... A45D 40/26

[52] U.S. Cl. ..... 132/218; 132/317; 132/320

[58] Field of Search ..... 132/218, 216, 132/317, 313, 320, 286; 15/207.2, DIG. 5, 160, 172, 143.1, 144.1; 401/129, 128, 122

[56] References Cited

U.S. PATENT DOCUMENTS

| | | | |
|---|---|---|---|
| 3,577,582 | 5/1971 | Aston . | |
| 4,135,527 | 1/1979 | Montiel | 132/218 |
| 4,403,624 | 9/1983 | Montgomery | 132/218 |
| 4,579,133 | 4/1986 | Seidler . | |
| 4,726,387 | 2/1988 | Sarica . | |
| 5,083,336 | 1/1992 | Atsumi et al. | 132/313 |
| 5,123,431 | 6/1992 | Wilson . | |
| 5,137,387 | 8/1992 | Byrd et al. . | |
| 5,205,301 | 4/1993 | Nakamura | 132/320 |
| 5,504,962 | 4/1996 | Byun | 132/313 |
| 5,743,279 | 4/1998 | Gueret | 132/218 |
| 5,765,573 | 6/1998 | Gueret | 132/218 |

FOREIGN PATENT DOCUMENTS

| | | |
|---|---|---|
| 0 693 263 | 1/1996 | European Pat. Off. . |
| 0 740 913 | 11/1996 | European Pat. Off. . |
| 55 558 | 9/1952 | France . |
| 1 174 544 | 3/1959 | France . |
| 2 564 712 | 11/1985 | France . |
| 2 603 780 | 3/1988 | France . |
| 8 907 317 | 8/1989 | Germany . |
| 59-117417 | 8/1984 | Japan . |
| 60-70216 | 5/1985 | Japan . |
| 60-168404 | 8/1985 | Japan . |
| 61-64817 | 5/1986 | Japan . |
| 61-194417 | 12/1986 | Japan . |
| 63-84504 | 4/1988 | Japan . |
| 6-13714 | 2/1994 | Japan . |
| 1 072 336 | 6/1967 | United Kingdom . |
| 2 126 890 | 4/1984 | United Kingdom . |

*Primary Examiner*—Gene Mancene
*Assistant Examiner*—Pedro Philogene
*Attorney, Agent, or Firm*—Oblon, Spivak, McClelland, Maier & Neustadt, P.C.

[57] ABSTRACT

A device (1) for applying a make-up product for keratinous fibers, in particular eyelashes, includes a handle (8) of a substantially flat profile, whose first end (10) carries an applicator element (50) having a free end. The applicator element is formed by a blade (6) defining a unitary structure elastically deformable in a multidirectional mode, and disposed substantially parallel to a plane of the handle. The blade (6) has two main sides (51, 52), the surface of at least one of the sides having reliefs (53) capable of retaining some of the product after a substantial portion of the surface has been brought into contact with the product. The width of the free end, measured along a first direction (X) parallel to the plane, is at least equal to a quarter of the average width of an arc of eyelashes.

29 Claims, 6 Drawing Sheets

DEVICE FOR APPLYING A MAKE-UP PRODUCT FOR KERATINOUS FIBERS, IN PARTICULAR EYELASHES, AND A PACKAGING AND APPLICATION UNIT USING SUCH A DEVICE

BACKGROUND OF THE INVENTION

1. Field of the Invention

The present invention relates to a device for applying a make-up product for keratinous fibers, in particular eyelashes. The invention is especially suitable for making up eyelashes by means of mascara packaged either in a liquid form, or in a solid form (in the form of a loaf or a cake), or a semi-solid form (for example, in the form of a block of foam with open or half-open cells, impregnated with the product in its fluid form).

2. Description of the Related Art

Numerous devices have been proposed for applying and packaging mascara. "Loaf" mascaras, for example as shown in FIG. 1, are used with a brush 300 of the shoe polish-type, the ends of whose bristles 600 are rubbed over a moistened loaf of mascara. The application surface of the mascara is the surface formed by the ends of the bristles of the brush. In this Figure, the brush 300 will be seen charging an eyelash 200, the bristles 600 being perpendicular to the longitudinal axis of the lash. The variation of the charge is proportional to the viscosity of the paste formed by the moistened loaf. The use of such a device is tedious; it requires the preparation and prior dosing of the paste, and the make-up action is not very precise. Moreover, in the course of use, the surface of the "loaf" is hollowed out. It then becomes difficult to charge the brush correctly via the free ends of the bristles. The quality of the make-up suffers considerably because of this. Finally, such brushes quickly clog up by the deposit of the product between the bristles of the brush.

Numerous devices have also been proposed for applying and packaging liquid mascara, comprising a rigid tubular body open at one end and containing the mascara, and an applicator suitable for being accommodated in this body when dipping into the mascara and being provided with a brush. An element accommodated in the body ensures the wiping of the brush when the applicator is being withdrawn from the body. Typically, such a brush has a central core formed by twisted wires gripping the bristles. These bristles form a helix whose axis is the core. The application of make up of the keratinous fibers, in particular the eyelashes, is effected by causing the applicator to pivot around the core. The smoothing of the lashes is thus effected with the bristles orientated perpendicularly to the lashes.

These applicators have many drawbacks. They do not always permit an optimum charging of the keratinous fibers, and in particular of the eyelashes: the bristles of the brush, disposed in a helix perpendicularly to the central core thereof, are short and it is very difficult to smooth the lashes over their whole length. The movement, which involves causing the applicator to pivot along its longitudinal axis, is also awkward and very imprecise. The lashes are not always properly separated.

Moreover, since the wiping of the brush is effected perpendicularly to the longitudinal axis of the brush bristles, the formula of the mascara is subject to shearing and it loses its qualities deriving from its particular viscosity; the formula may form lumps, and hence provide a poor smoothing of the lashes. This makes it necessary to use compositions that are not sensitive to shearing and limits the number of the compositions that can be used. This particularly the case for mascaras with a high pigmentary charge. Finally, the element accommodated in the body for the wiping of the brush produces a disagreeable sucking noise due to the low pressure created inside the body when the brush is being withdrawn.

Still in the field of liquid mascaras, FR-A-2564712 discloses the use of a brush whose free end carries a small number of axially disposed bristles, for applying small quantities of a cosmetic product in narrowly confined zones such as the corners of the eyes. The application of the cosmetic product such as mascara over the essential part of the arc of the user's eyelashes is obtained by means of a conventional brush, either separate from the brush with the axial bristles, or formed by radially disposed bristles on the stem whose end carries radial bristles (see FIG. 8 of the above mentioned application).

Although satisfactory in many respects, the brush-type applicators have the drawback of being fragile. Indeed, experience shows that in the course of use, the bristles break or are degraded because of the considerable stresses to which they are subjected, notably during the insertion of the applicator into the reservoir containing the formula to be applied, in particular during the insertion of the applicator through the wiper device used in the conventional packaging and application units, and also during the application of the product to the surface to be treated.

Moreover, such applicators suffer from fast clogging up.

SUMMARY OF THE INVENTION

It is thus an object of the invention to provide a device for applying a make-up product for keratinous fibers, in particular eyelashes, not having the drawbacks set out with reference to the conventional application devices, and which affords a simple and homogeneous making up of the keratinous fibers.

According to a first aspect of the invention, these objects are attained by making a device for applying a make-up product for keratinous fibers, in particular eyelashes, comprising a handle of a substantially flat profile, and whereof at least a first end carries an applicator element having a free end, the applicator element being formed by a blade defining a unitary structure elastically deformable in a multidirectional mode, and disposed substantially parallel to a plane of the handle, the blade having two main sides, the surface of at least one of the sides having reliefs capable of retaining some of the product after a substantial portion of the surface has been brought into contact with the product, the restitution of the product being effected by causing the substantial portion to be brought into contact with the keratinous fibers along the axis of the fibers, the width of the free end, measured along a first direction parallel to the plane, being at least equal to a quarter of the average width of an arc of eyelashes. The blade thus formed of an elastically deformable material forms a structure deformable in all spatial directions, particularly in compression, torsion, stretching, which allows it to adapt its shape to any surface profile to be treated or to any surface profile whereon the product is to be taken up.

The term "unitary structure" aims to differentiate the invention from any conventional application structure, for example of the type with bristles wherein the bristles forming the brush are free relative to one another over a substantial portion of their length, and can all pivot independently relative to the others. In accordance with the invention, the blade forms a unitary structure in terms of its mobility, although it may have a structure with several layers.

The reliefs present on one and/or the other of the sides of the blade retain the product, in particular by surface tension or capillarity effect.

Within the meaning of the present application, the term "arc of the eye lashes" designates the average curve (typically a circular arc) along which the lashes of an adult person are implanted. Typically, the average width of an arc of the eyelashes varies in an adult between approximately 3 cm and 4 cm. With a blade with a width less than approximately ¼ of the average width of an arc of eyelashes, the homogeneity of the make-up obtained is not satisfactory.

In the case of a mascara, and with such a configuration, the take-up of the product is effected by bringing the blade over a substantial portion of its length into contact with the product, either by immersion in a liquid formula, or by bringing one of the sides of the blade into a tangential contact with the free surface of a solid or semi-solid block. The restitution of the mascara onto the keratinous fibers is effected by bringing the blade into contact with the keratinous fibers over a substantial portion of its length, and this along the length of the fibers.

Because of its structure, its mode of charging (by bringing the blade into contact with the length of the keratinous fibers over a substantial portion of its length, and not via the end of the bristles of the conventional brushes), and because of its small thickness, the applicator element will not clog up to any substantial extent, and will instantaneously resolubilize the dry product. The free end of the blade may have prongs advantageously used for separating the eyelashes after the application.

Moreover, with such a substantially flat configuration of the handle, it can be easily gripped between the thumb and forefinger. Furthermore, in the case of mascara, the application of the product is no longer effected in an uncertain manner by causing the applicator to pivot along its axis as in the case of the known applicators, but instead by smoothing the keratinous fibers, and the eyelashes in particular, over their whole length from their base towards their end, the blade touching the lashes tangentially. The movement is much simpler than with the known applicators. It is, moreover, possible to incline the applicator at will, and thus to recurve the lashes according to the desired curve.

The width of the applicator may be comprised between 0.75 cm and 3 cm. The free end of the applicator element has a thickness which is preferably at most equal to the thickness of the first end of the handle, these thicknesses being measured along a second direction perpendicular to the plane. Typically, such a thickness is between 0.5 mm and 5 mm.

The handle has an effective length sufficient for ensuring optimum charging of the treated keratinous fibers. For eyelashes, the average length of the blade, along a third direction perpendicular to the first and second directions, preferably ranges from 10 mm to 60 mm and more preferentially from 10 mm to 30, and still more preferentially from 15 mm to 20 mm.

The applicator blade has a flexible to semi-rigid consistency. This relative rigidity ensures a more effective smoothing of the lashes and very good recurving of the lashes. The elastically deformable material has a hardness comprised between 10 Shore A and 90 Shore D, and preferably comprised between 30 Shore A and 60 Shore D. By way of example, the applicator blade is made of an elastomeric material chosen from the group of elastomers comprising polyethylene, polyurethane, polyester, polyether block amides, polyvinyls, terpolymers of ethylene, propylene and of a diene (EPDM); sequenced polymers of styrene-butadiene (SEBS-SIS); elastomers of silicone, nitrile, butyl etc. The blade may also comprise sliding agents such as molybdenum disulphide, bactericidal agents such as the Microban® product sold by the Microban Product Company, or yet again, moisture-absorbing agents.

According to a variant of the present invention, the applicator element is formed by at least one block of foam with open, half-open or closed cells. By way of an indication, a foam of polyurethane, polyethylene, polyvinyl chloride, polyether, NBR (natural rubber), SBR (synthetic rubber) etc. may be used.

Advantageously, the applicator element has an elastically deformable core sandwiched between two foam blades. This makes it possible to stiffen the structure of the applicator blade, in particular in the case of liquid products for which it is necessary to cause the applicator element to pass through a wiper device before application. Such a stiffening of the structure makes it possible to facilitate the insertion of the applicator blade into the wiper. The elastically deformable core may have a length along the third direction greater than the length of the foam blocks between which it is sandwiched; in the vicinity of the free end of the applicator element the core may have means such as prongs or bristles capable of separating the keratinous fibers after application. Such means may be molded together with the applicator blade, they may be bonded or attached to the free end of the blade, or they may be duplex injection molded on the blade.

In particular in the case of an applicator made of foam, the reliefs may be formed by an embossed finish oriented along the third direction, the embossed finish being obtained by pressing the foam, or by means of longitudinal welds. However, in the case of a foam, the relatively rough surface state of the foam may on its own define reliefs that are sufficient for retaining some of the liquid in sufficient quantity. In the case of a foam with open or half-open cells, the liquid is also retained in the cells of the foam. The reliefs may also be formed by grooves, striations, openings passing through at least a part of the thickness of the blade, diamond-shaped bosses, grooves, hollows, etc.

According to an advantageous embodiment, the applicator element has a flocked coating over at least a portion of at least one of its sides. Such a flocked coating participates at least partly in retaining liquid on the applicator blade. Besides, it imparts more softness to the makeup. Such a flocked coating may be formed by a mixture of bristles of different diameters and/or different kinds and/or different lengths and/or different hardnesses.

The shape of the free end of the applicator is chosen according to the application to be obtained. By way of example, the free end of the applicator element has a bevelled, concave or convex shape.

The handle of the applicator element may be made of an elastomeric material so as to give it a certain flexibility. The handle may also have a profile that is axially slightly curved in the manner of a tile, the profile of the blade substantially following the curvature of the handle. Alternatively, the handle may be flexible to allow the user to give it a slightly convex shape during application so as to conform substantially to the curvature of the arc of the eye lashes. The handle may instead be articulated in two parts along an axis parallel to the first direction. This contributes to improving the make-up action. In the case of a product packaged in the form of a solid or semi-solid product block, the articulation makes it possible to facilitate bringing one or the other of the sides of the blade into contact with the block of the product.

The end of the handle on the opposite side to the first end may have means for separating the keratinous fibers after application. Such a separating element advantageously completes the combing obtained by the free end of the applicator blade, with prongs if required, and may be formed by a comb. When the application device in accordance with the invention is used in a compact-type packaging unit, the body of the case may, when in its closed position, perform the function of a handle for the comb. Such a comb may be obtained by molding together with the handle. Alternatively, the separating element may be formed by a brush comprising an arrangement of bristles disposed radially on a central core.

The handle may be formed by two parts articulated around an articulation means parallel to the first direction. This permits an inclination of the applicator element relative to the handle, which improves the applying action. Such an articulation means may be formed by means of a film hinge or a profiled section.

According to a second aspect of the invention, there is provided a unit for packaging and applying a make-up product for keratinous fibers, eyelashes in particular, comprising a reservoir containing the product in liquid form, the reservoir being provided with a wiper device and being obturated in a detachable manner by an application device in accordance with the first aspect of the invention.

Advantageously, the wiper device is formed by a sleeve with a cross-section matched to the cross-section of the applicator element, so as to wipe it along its longitudinal axis. The handle has an internal surface that may be at least partly covered by a flocked coating. The handle may also have reliefs over at least a portion of its internal surface so as to reduce substantially the piston effect during the withdrawal of the applicator, which effect causes the sucking noise. The wiper may have at least one longitudinal slot. Such a wiper device may be made of foam, an elastomer or a thermoplastic material.

Advantageously, the liquid product as well as the wiper device are contained inside a flexible pouch, the withdrawal of the applicator element, with a view to an application, producing inside the pouch low pressure causing the internal sides of the pouch to bear against the sides of the applicator element, so as to spread the liquid product over the sides. In this case, the wiper may be molded together with the flexible pouch. Such a configuration ensures a better distribution of the product over the applicator blade.

According to a third aspect of the invention, a unit is also obtained for the packaging and application of a make-up product for keratinous fibers, eyelashes in particular, comprising a) a body having a bottom wherein there is disposed a solid or semisolid block of the product, having a free surface and a lid for covering the said bottom in a detachable manner, and b) an application device in accordance with the first aspect of the invention, the taking up of the product being effected by causing the blade to come into contact over a substantial portion of its length with the free surface of the block of the product.

In the closed position of the unit, the handle is advantageously situated at least in part outside a substantially closed space formed when the lid is in the closed position on the bottom. This position makes it possible to reduce substantially the size of the case, in particular its thickness and/or its width. Moreover, the handle is thus separated from the product, which allows it to be kept clean. Such a configuration makes it possible to give the thus formed make-up unit a shape close to that used for the liquid mascara formulas. Moreover, it allows the configurations to be made less commonplace.

According to one embodiment, the lid is slidably mounted on the bottom, the handle serving as an actuating element for causing the packaging and application unit to open, and to allow access to the block of the product. This makes it possible to dispense with auxiliary opening means which are most frequently complicated, expensive and fragile. Alternatively, the lid may be articulated on the bottom.

The handle may be obtained by molding an elastomeric or thermoplastic material. In the case of an application device comprising a handle articulated in the closed position of the lid on the bottom, the articulation is preferably contained inside the case so as to immobilize the handle relative to the plane.

The product may be introduced into the bottom by compacting, by casting in a hot or cold state or directly in the form of a block joined to the bottom by any appropriate means (bonding for example). The free surface of the product may be flat or may form a convex or concave profile. Because of the multidirectional flexibility, the structure of the applicator is capable of perfectly assuming such a profile, and hence permitting a homogeneous charging. Alternatively, a semi-solid block is made in the form of a block of foam with open or half-open cells, wherein the product is impregnated in a fluid form. This makes it possible to have a product available ready for use, without the need for moistening it beforehand. By way of example, a foam of polyurethane, polyvinyl chloride, polyethylene, epoxy resin or polystyrene is used.

BRIEF DESCRIPTION OF THE DRAWINGS

Apart from the arrangements set out above, the invention consists of a certain number of other arrangements which will be explained below with regard to non-restrictive examples of the embodiment, described with reference to the attached Figures, wherein.

DETAILED DESCRIPTION OF THE PREFERRED EMBODIMENTS

Figure 3:
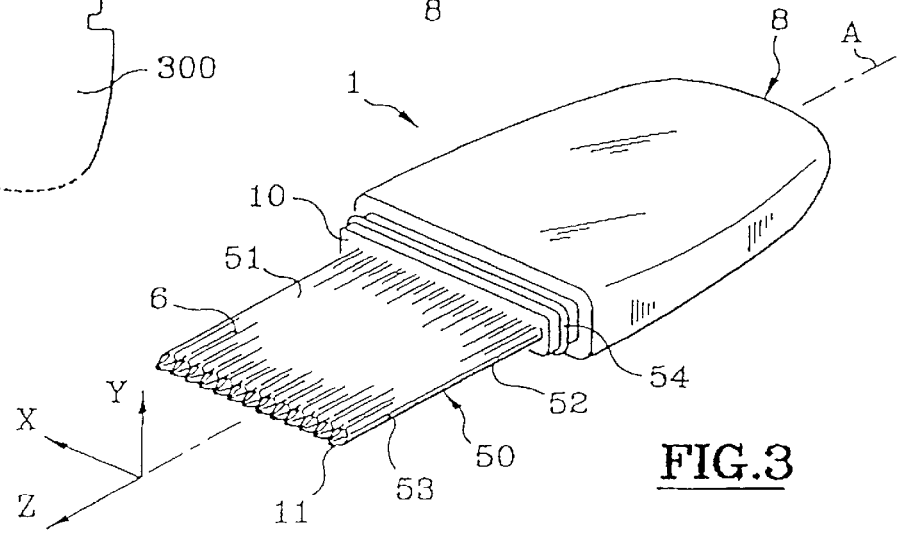
FIG. 3 illustrates a first embodiment of an application device in accordance with the invention.

FIG. 3, to which reference will now be made, illustrates a first embodiment of the application device 1 in accordance with the first aspect of the invention. It includes a handle 8 of a substantially flat shape. The term "substantially flat" reflects the fact that it defines a structure of a small thickness relative to its other dimensions, and in particular relative to its length. By way of example, the handle 8 may have a profile that is axially slightly curved in the manner of a tile, the profile of the blade substantially following the curvature of the handle. Alternatively, the handle 8 may be flexible to allow the user to give it a slightly convex shape during the application, so as to conform substantially to the curvature of the arc of the eye lashes.

One of the ends of the handle carries an applicator element 50 in the form of a blade 6 made of an elastically deformable material. According to a first embodiment, the blade is made of an elastomeric material such as polyethylene, polyurethane, polyester, polyether block amides, polyvinyls, terpolymers of ethylene, propylene or a diene (EPDM); or sequenced polymers of styrene-butadiene (SEBS-SIS); or elastomers of silicone, nitrile, butyl etc. Each of the main sides 51, 52 of the blade 6 has grooves 53 capable of retaining some of the product, either after having been immersed in a reservoir containing such a product in a liquid form, as will be seen in greater detail with reference to FIGS. 9 to 12, or after having been applied to the free surface of a solid or semi-solid block, as will be seen in greater detail with reference to FIGS. 13A to 17B.

A first orthogonal direction X contained in a median plane of the part 10 of the handle 8 is directed perpendicular to the longitudinal axis of this handle, a second direction Y is perpendicular to the plane of the part 10 of the handle 8, and a third direction Z, orthogonal to direction X and parallel to the longitudinal axis of this handle, is perpendicular to the plane of X and Y. The blade 6 is mounted on the part 10 parallel to the median plane of the latter and orientated along a direction substantially parallel to Z. In practice, the side edges of the applicator blade may slightly diverge or slightly converge relative to the third axis Z. The blade 6 may have a very slightly curved profile so as to promote still further the application to the eyelashes. By way of example, the handle 8 has an average length measured along the third direction Z ranging from 1 cm to 6 cm, and preferably ranging from 2 cm to 5 cm. Its average thickness along the Y axis varies between 2 mm and 7 mm, and preferably between 2 mm and 5 mm. Its average width along the X axis varies between 7.5 mm and 40 mm and preferably between 10 mm and 35 mm. The blade 6 may be welded or bonded to the handle or obtained by molding, for example duplex injection molding, or it may be catch-engaged on the handle 8. The end 10 of the handle 8 whereon the blade is mounted has a cross-section smaller than the cross-section of the rest of the handle and has in this embodiment a rib 54 suitable for a detachable mounting by catch engagement on the neck of a container, for example containing a make-up product in a liquid form, the internal surface of the neck having a groove capable of receiving the said rib 54. Such an arrangement ensures a leakproof mounting of the application device on a reservoir for the product.

The width of the blade along the direction X in the vicinity of its free end is at least equal to one quarter of an arc of the lashes, and in particular at least 0.75 cm, and is preferably between approximately 0.75 cm and 3 cm. The thickness of the applicator element, also measured at the free end of the blade and along the direction Y, is at most equal to the thickness of the handle and in particular the thickness of the part 10, also measured along the direction Y. In practice, this thickness is from 0.5 mm to 5 mm.

The average length of the blade 6 measured along the third direction Z is sufficient to allow the keratinous fibers, in particular the eyelashes, to be charged along one or the other of the main sides of the blade. This length generally ranges from 4 to 60 mm, preferably from 5 to 40 mm, and more preferentially, from 10 to 30 mm. In a preferred embodiment of the invention, the blade 6 has a length ranging from 15 to 20 mm.

The depth of the grooves along the Y axis depends on the make-up that is intended to be obtained. For a light make-up, grooves of a shallow depth are used. For a heavier make-up, grooves of greater depth are used. Advantageously, it is possible to obtain grooves of different depths and/or different widths in alternation, for example on the same blade, so as to give the make-up more scope for variation. Typically, the depth of the grooves 53 may vary from 0.1 mm to 3 mm, and preferably from 0.5 mm to 2 mm. The free end of the applicator element 50 advantageously ends in prongs 11 to allow the keratinous fibers to be separated after the application if required.

Figure 4A:
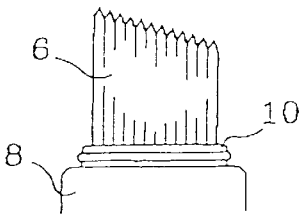
FIGS. 4A–4C illustrate three variants of the embodiment of FIG. 3.
Figure 4B:
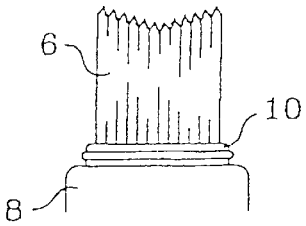
Figure 4C:
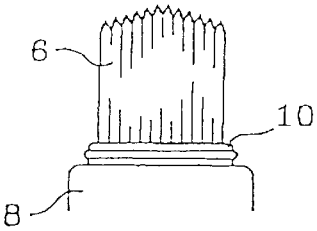

In the embodiment of FIG. 4A, the free end of the blade 6 is cut at a bevel. In the embodiment of FIG. 4B, the free end of the blade 6 has a concave shape. In that of FIG. 4C, it has a convex shape.

Figure 5:
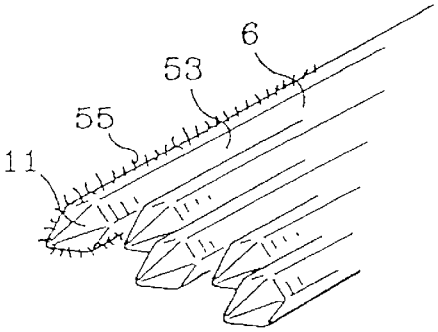
FIG. 5 illustrates another variant of the embodiment of FIG. 3.

As shown in FIG. 5, the blade 6 may be covered at least partly by a flocked coating 55. Such a flocked coating may have a double function. It forms, in the same way as a relief or groove, a means capable of retaining some of the product. Moreover, it imparts greater softness to the application of the product. The flocked coating may be used alone or in combination with any other means for retaining the product (grooves, striations, openings, slots, etc.). The flocked coating may have flocks of different diameters, and/or lengths and/or kinds. In the embodiment illustrated, only the prongs 11 are covered by such a flocked coating. It is obvious that the whole surface of the blade 6 could be flocked. In the embodiment illustrated in this Figure, the prongs 11 have different lengths.

Figure 6:
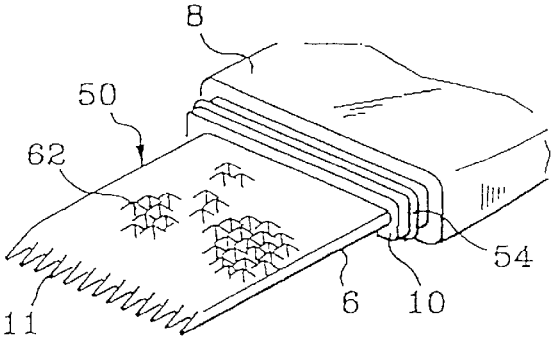
FIG. 6 illustrates a second embodiment of the application device in accordance with the invention.

In the embodiment of FIG. 6, reliefs formed on one main side 51, or the other 52, of the blade 6 take the form of diamond-shaped bosses 62. Advantageously, such bosses are distributed in a staggered configuration on the surface of the blade. The height of the blades is chosen according to the desired charge. In the same way as for the grooves of FIGS. 3 to 5, bosses of different heights may be provided, distributed either at random or in an organized manner, on the surface of the blade 6. In the same way as for the embodiment of FIG. 6, the free end of the blade 6 has prongs 11 for combing the keratinous fibers after application. Although not shown in the Figures, a flocked coating may be disposed over the whole or part of the surface of the blade.

Figure 7:
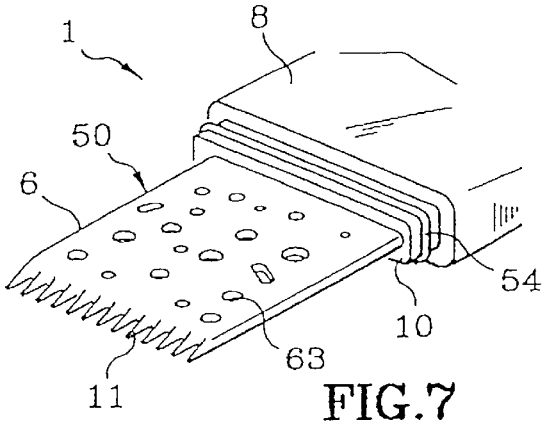
FIG. 7 illustrates a third embodiment of the application device in accordance with the invention.

In the embodiment of FIG. 7, the reliefs capable of retaining some of the product are formed by openings 63 passing through the thickness of the blade. These openings may be substantially identical over the whole surface of the blade. Alternatively, openings of different cross-sections, and/or shapes and/or sizes are distributed over the surface of the blade. The number, size and shape of the holes is chosen according to the desired product charge and the desired aspect of the make-up. Typically, the surface area of each of the openings varies from 0.2 $mm^2$ to 5 $mm^2$ and preferably from 0.5 $mm^2$ to 3 $mm^2$.

In the embodiment of FIGS. 8A–8D, the applicator element 50 is made at least in part from at least one foam block. The foam may have open, cells half-open cells or closed cells. By way of example, the foam may be made of at least one of polyurethane, polyethylene, polyvinyl chloride, polyether, NBR (natural rubber), SBR (synthetic rubber), etc.

Figure 8A:
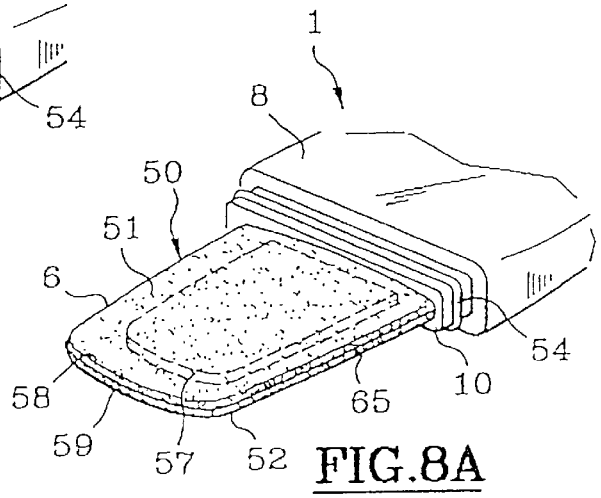
FIGS. 8A–8D illustrate a fourth embodiment of the application device in accordance with the invention.
Figure 9:
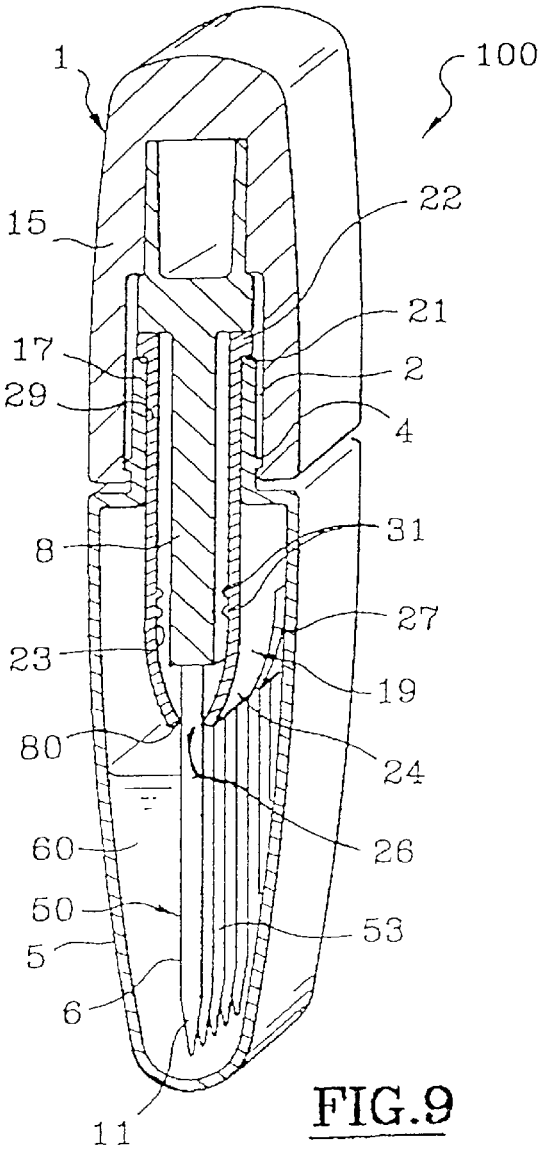
FIGS. 9, 10, 11A–11B and 12 illustrate a packaging unit for a make-up product in liquid form, using an application device in accordance with the invention.

In the embodiment of FIG. 8A, the applicator 50 is formed by two foam blocks 58, 59, between which there is sandwiched a semi-rigid core 57. The two foam blocks may have identical or different characteristics. The central core may be made of any appropriate material. By way of example, the core may be made of a thermoplastic material such as polyethylene or polypropylene. This core makes it possible to stiffen the structure of the applicator element 50 and it is particularly advantageous when the application device is intended to be inserted into a packaging and application unit such as shown in FIG. 9, which unit comprises a wiper device in the form of a sleeve. The stiffening produced by the central core facilitates the application of the product and also makes it possible to facilitate the insertion of the applicator into the sleeve. In this embodiment, the core 57 is contained entirely inside the two-layer structure of foam, a peripheral weld 65 being obtained all around the blade 6 so as to join together the two foam blocks 58, 59. In the case of a foam with open cells or half-open cells, the product is retained in the cells of the foam and/or on the surface of the foam because of the relatively rough surface of the foam. In the case of a foam with closed cells, the product is retained on the surface of the foam by an appropriate choice of its surface condition. Alternatively, the whole or part of the surface is covered by a flocked coating. Other reliefs may be obtained using striations, grooves or an embossed finish. Such reliefs may be obtained by cutting, pressing or any other technique.

Figure 8B:
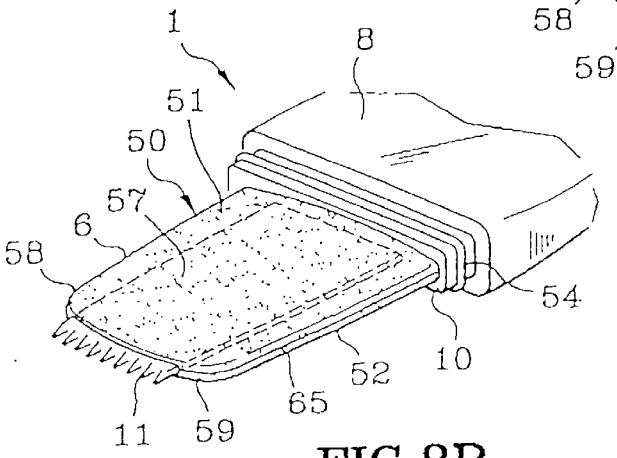

In the embodiment of FIG. 8B, the core 57 is longer than the length of the foam blocks 58, 59 so that a portion of the core emerges at the free end of the applicator 50. This emergent portion carries prongs 11 capable of combing the keratinous fibers after the application. The two foam blocks 58 and 59 are joined to each other by means of weld lines 65 formed laterally on either side of the axis of the application device 1.

Figure 8C:
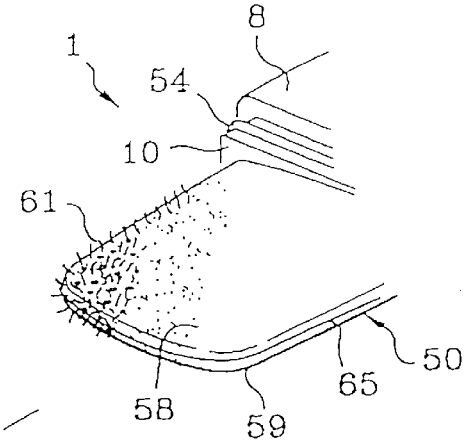

In the embodiment of FIG. 8C, the blade 6 is formed of a foam with closed cells. The surface of the blade is covered by a flocked coating 61 ensuring the retention of the make-up product and imparting great softness to the application. The foam block is obtained by molding, or by joining two foam slabs 58, 59 by means of a peripheral weld line 65. The two foam slabs may have the same or different characteristics. By way of example, the two foam blocks may have different densities and/or porosities and/or rugosities so as to provide two make-up qualities according to the side of the blade which is used.

Figure 8D:
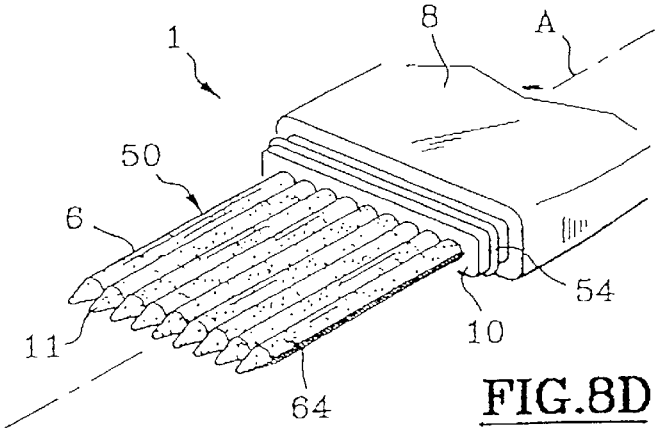

In the embodiment of FIG. 8D, the blade 6 is obtained by molding a foam material. An embossed finish 64 is obtained either by pressing the foam or by means of weld lines orientated parallel to the axis A of the application device. The depth, pitch and the configuration of the embossed finish are chosen according to the make-up aspect desired.

Figure 1:
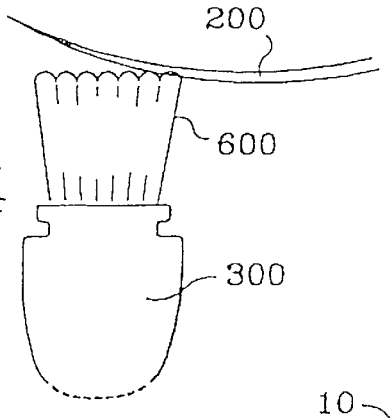
FIG. 1 is a sectional view illustrating the making up of an eyelash by means of a brush of the shoe polish-type, for a "loaf" mascara.
Figure 2:
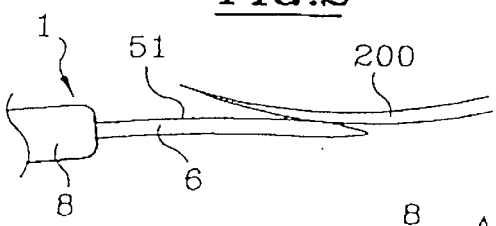
FIG. 2 is a sectional view illustrating the making up of an eyelash by means of an application device in accordance with the invention.

With an application device such as described with reference to FIGS. 2 to 8D, the mascara is applied to the eyelashes in an extremely simple manner, the action for smoothing the lashes being effected upwardly from the base of the lashes towards their ends, with one (51) of the sides of the blade 6 tangentially touching the lashes 2. Such an application is shown in FIG. 2. This action is far more precise than that of the prior art (FIG. 1). Indeed, the flat handle and the special configuration of this applicator make it possible to hold it easily during its use and to obtain a better calculated make-up facing the lashes due to a more ample and freer movement. Such an applicator allows the user to actually follow the blade 6 along the lashes and to charge the lashes in a very precise manner. Finally, the user can terminate the movement by inclining the applicator so as to bring the prongs 11 perpendicularly to the lashes. She can thus perfectly separate and curve the lashes, using the end tip of the prongs, and/or by using an auxiliary separating device which will be described in greater detail below. Moreover, such an application device 1 is very simple to make. The handle may be, for example, made of a molded plastic, wood or any other material generally used in the manufacture of applicators.

Referring to FIGS. 9 to 12, there will be described an application device in accordance with a first aspect of the invention for applying a make-up product packaged in liquid form. In the embodiment illustrated in FIG. 9, the packaging unit 100 comprises in the main an applicator 50 and a reservoir 5 for mascara 60. In contrast to conventional units, this unit is extra flat. The applicator 50 is provided with a flat handle 8 and an extra flat blade 6 directly fixed to this handle, parallel to the plane of the handle. In the embodiment illustrated, the blade is made of an elastomeric material and has a succession of grooves 53 orientated along the axis of the packaging unit. The blade ends in prongs 11 capable of combing the lashes after the application of the product. The length of the blade along the axis of the packaging unit is substantially equal to the height of the reservoir 5 up to the free end 24 of the wiper 19.

The handle 8 is mounted on a cap 15 which performs the function of a lid and which is capable of being catch engaged (by a groove 2 and bead 4) on the reservoir 5. The reservoir 5 has a neck 17 whose internal side 29 is provided with a wiper 19 whose one end 29 situated opposite the cap 15 is fixed on this neck 17. In another embodiment of the invention, this end 22 can bear on the neck 17 of the reservoir 5.

At the end 22 of the wiper, the handle 8 has a sealing system. This may be a gasket as shown in this Figure, or a washer which bears on a collar. On the opposite side to its fixed end 22, the wiper 19 has a free end 24 in which there is arranged an opening 80 having an oblong shape, or the shape of a flattened ellipse whose major axis is orientated along the first direction defined above, so as to wipe the blade 6 along its axis when the applicator is being withdrawn. After wiping, only the product contained between the tips of the grooves or other reliefs remains on the applicator 50. At its end 24, the wiper may have another sealing system, which may be used alone or jointly with the sealing system 21 of the handle. It may also have reliefs 31 on its internal side 23 to avoid the "piston effect" when the applicator is being withdrawn. This configuration of the blade and the wiper prevents the disagreeable sucking noise and spattering of the product observed in the known packaging units. The wiper may be made from a rigid or semi-rigid material, preferably from elastomers, foams or thermoplastic materials.

The reservoir 5 may be a tube made of a flexible material. The user can then control the wiping by simple pressure on the reservoir at the level of the wiper. This may be obtained by one or several longitudinal slots 27 cut in the wiper along the longitudinal axis of the blade.

Figure 12:
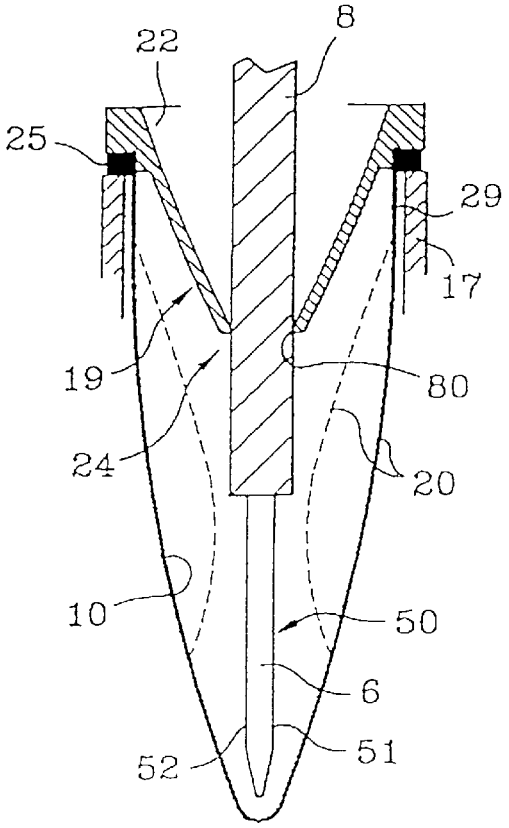

In the embodiment of this FIG. 9, the packaging unit is closed and the opening 80 of the wiper is situated opposite the fixed end 26 of the blade. It is possible to position this opening 80 opposite the handle 8, as shown in FIG. 12. A portion of the handle 8 then dips into the reservoir 5. In this case, the wiper has to be shaped according to the shape of the handle in order to ensure the wiping of the handle and of the blade 6, always in the longitudinal direction of the blade, when the applicator is being withdrawn. In this case, the blade has a thickness substantially equal to that of the handle.

When the user withdraws the applicator 50 from the reservoir 5, the blade is wiped at the level of the opening 80 of the end 24 of the wiper 19. Since this wiping is effected parallel to the longitudinal axis of the blade, it does not shear the formula of the mascara. On completion of the extraction of the applicator, the user slightly inclines this applicator and the free end of the blade is automatically wiped by friction of the prongs along the internal side of the wiper or on the edge of the opening of the wiper. To facilitate extraction, a portion of the handle may be flexible. Such a packaging unit makes it thus possible to use compositions generally sensitive to the shearing phenomenon and opens the door to new mascara formulas.

Figure 10:
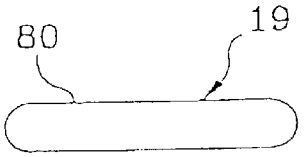
Figure 11A:
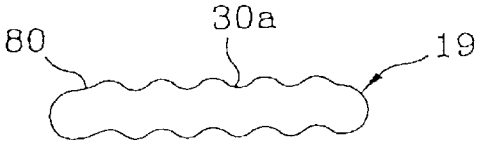
Figure 11B:
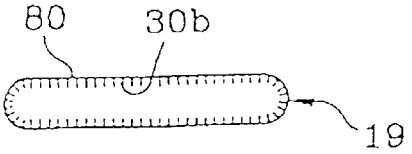

FIG. 10 shows, in greater detail, the wiper 19 provided with an opening 80 of an oblong shape and suitable for the applicator in accordance with the invention. Such a wiper can be used to obtain a heavy charge of mascara. The wiper may be provided with reliefs on its opening 80. In particular, it may be provided with corrugations 30*a*, as shown in FIG. 11A. In another embodiment of the invention shown in FIG. 11B, the wiper may be flocked. Its internal side is then provided with small particles 30*b* due to the flocking. Such wipers are used to obtain a light charge of the blade, and hence of the keratinous fibers.

According to a preferred form of the invention, the mascara can be contained in a flexible pouch 20 shown in FIG. 12 and having an opening 25. The opening 25 has a cross-section equal to the internal cross-section of the neck 17 of the reservoir, the edge of this opening 25 being held between the internal side 29 of the neck 17 and the end 22 of the wiper 19. The end 24 of the wiper 19 is situated inside the internal flexible pouch 20. The dashed lines show the position of the flexible pouch 20 when one has started to withdraw the applicator. Due to the low pressure, the sides 10 of the flexible pouch are then drawn in and stick along the blade 6; the blade is therefore charged with mascara which is spread over the blade 6 by the internal sides 10 of the flexible pouch 20. When the applicator is being withdrawn, this flexible pouch also prevents the accumulation of the product in the vicinity of the wiper due to the piston effect observed in the known packaging units. It thus prevents the wiper from being clogged up.

Such a mascara packaging unit is very easy to make; it may be made of any material generally used in the manufacture of cosmetic accessories. Since it is possible for the applicator not to have a central metal core, the packaging unit of the invention may be made wholly of organic materials, and in particular solely of plastic materials, and may because of this be completely recyclable.

Figure 13A:
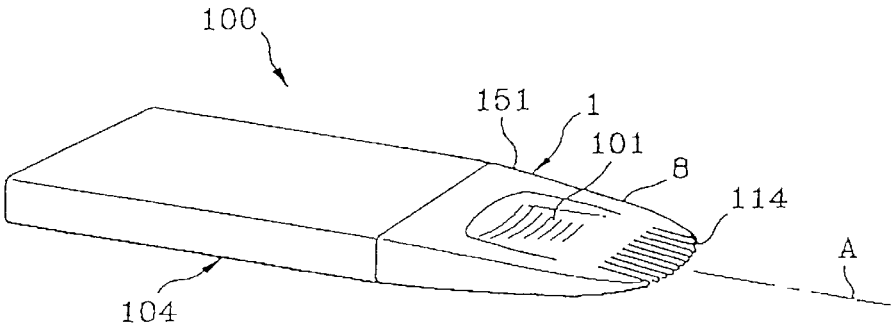
FIGS. 13A–13C, 14A–14B, 15, 16 and 17A–17B illustrate various embodiments of a packaging unit for a make-up product in the form of a solid or semi-solid block, and using an application device in accordance with the invention.
Figure 13B:
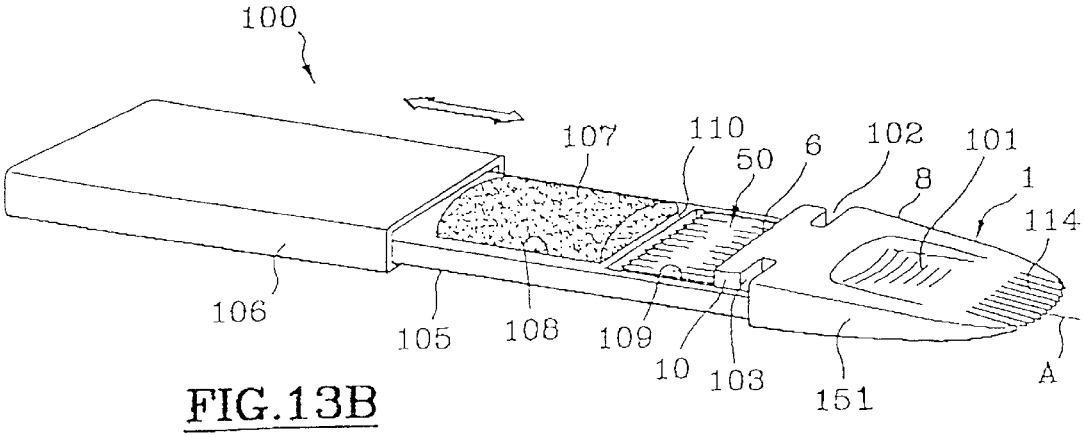

There will now be described an application device in accordance with the second aspect of the invention for the application of a make-up product, in particular a mascara packaged in a solid or semi-solid form in a case. The packaging and application unit 100 illustrated in FIGS. 13A–13C has a substantially elongate shape, comprising a body 104 and an application device 1. In the embodiment illustrated, the application device 1 is mounted so that in the closed position of the case 100, the handle 8 is at least partly outside the closed space delimited by the body 104 of the case. The handle 8 has on at least one of its sides a sunk portion 101 forming a finger grip. Its free end carries a comb 114 molded on the handle 8. As shown in FIG. 13B, the body of the packaging and application unit 100 consists of a bottom 105 mounted in the manner of a sliding drawer inside a portion 106 forming a lid. By pulling the handle 8 the case is caused to open, thus permitting access to the block of solid or semi-solid product 107. The bottom 105 forms a receptacle having two compartments 108, 109 separated by a partition 110. The first compartment 108 contains a block 107 of the product in the form of a "loaf" or "cake". Alternatively, the semi-solid block is formed by a block of foam with open or half-open cells impregnated with the product in a fluid form. By way of example, a polyurethane, polyvinyl chloride, polyethylene, epoxy resin or polystyrene may be used. The foam block may or may not be covered by a screen.

Advantageously, the product is a mascara for application to the eyelashes. The product may be cast or compacted inside the compartment 108. Ribs or other reliefs may be provided for holding the product in the bottom of the compartment 108. Alternatively, the block 107 may be mounted directly in solid form inside the compartment. By way of example, it may be bonded or force-fitted inside the compartment 108.

Figure 13C:
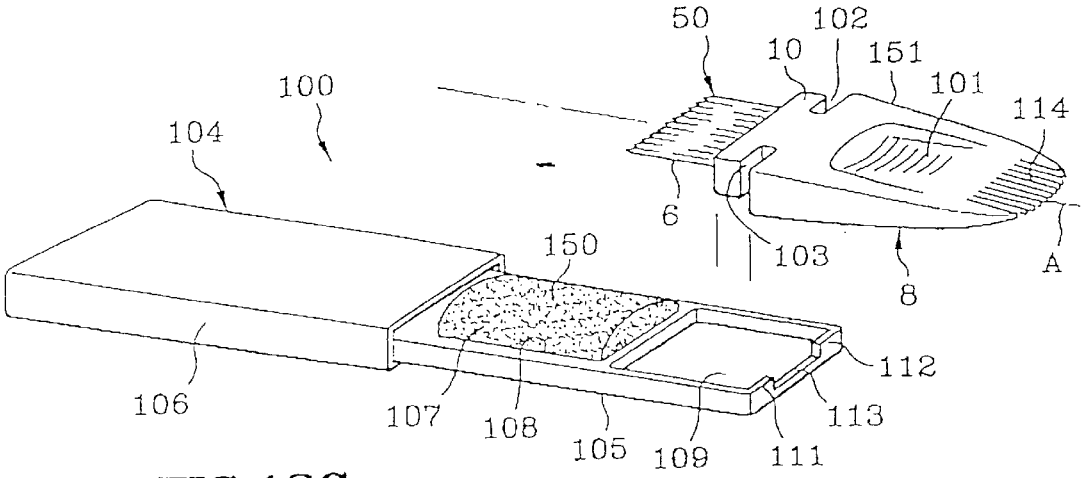

The second compartment 109 is intended to receive the applicator element 50. The applicator element has a blade 6 which may correspond to that which has been described with reference to FIGS. 2 to 8D. Such an arrangement therefore does not require any other description. The blade 6 is carried by the free end 10 of the handle 8. The handle 8 has a part 151 which is, as shown in FIG. 13A, situated outside the case when the case is in its closed condition. Two grooves 102, 103 are disposed head-to-tail at the interface between the part 10 and the part 151, which grooves are aligned along an axis perpendicular to the axis A of the application device 1. The grooves 102 and 103 are U-shaped and have their respective bottoms situated opposite one another. These grooves 102, 103 are disposed so as to be inserted in the portions of the edges 111 and 112 of the bottom 105 of the case (FIG. 13C). The portions of the edges 111 and 112 are separated by a recess 113 capable of receiving the part of the handle situated between the respective bottoms of the two grooves 102, 103. Thus in the mounted position shown in FIG. 13B, the blade 6 rests substantially flat in the bottom of the compartment 109.

The end 10 of the handle 8 has a cross-section slightly smaller than the internal cross-section of the cover 106 and is also disposed inside the compartment 109. The edges 111 and 112 of the front portion of the compartment 109 are inserted in the grooves 102 and 103, thus immobilizing the application device 1 axially in the case. The part 151 of the handle 8 is outside the compartment 109. The application device 1 is pushed down into the receptacle 109 by a movement in a plane parallel to itself As will be seen more clearly in FIG. 13A, in the closed position the part of the handle 8 adjacent to the body 104 outside the case has a cross-section substantially identical with the external cross-section of the cover 106, so that the part 151 of the handle 8 is disposed in the extension of the body 104.

The end of the handle 8 on the opposite side to the end 10 advantageously forms a comb 114 which, after the mascara has been applied by means of the applicator element 50, is used to separate the lashes which might cling together during the application of the product. This comb 114 advantageously forms a single piece with the handle 8. By way of example, the handle as well as the case unit is made by molding thermoplastic materials such as polyethylenes, polypropylenes, polyvinyl chlorides, polystyrenes, etc. Again by way of example, the handle is formed by an elastomeric material so as to give it a certain flexibility. At least one of the large sides of the handle 8 has a sunk portion 101 to facilitate the gripping of the application device 1 between the thumb and forefinger.

Figure 14A:
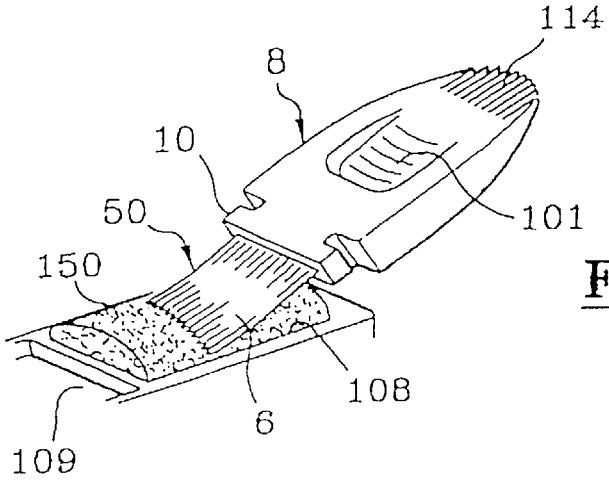
Figure 14B:
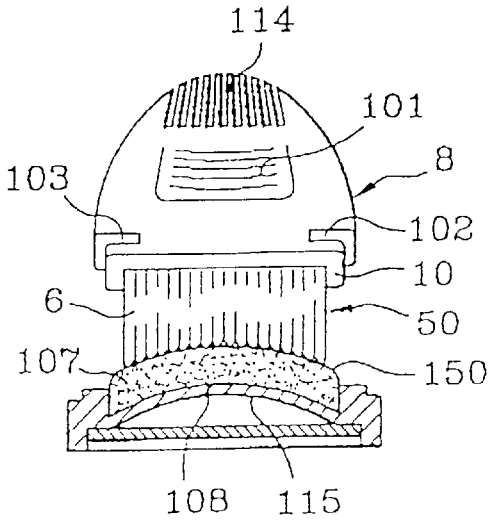

FIGS. 14A and 14B illustrate the taking up of the product by means of the application device. As is clearly shown in FIG. 14A, after having solubilized the product on its surface, (by means of saliva for example) the product is taken up by means of the applicator element 50 by inclining the application device 1 so as to place the blade 6 into contact with the product over a substantial portion of its length and by displacing the applicator over the free surface of the "cake." Thus the blade 6 is charged mainly over its length, in contrast to the conventional applicators of the type shown in FIG. 1, which are charged mainly at the end of the bristles. The application of the mascara on the lashes is effected in the way indicated in FIG. 2 by smoothing the keratinous fibers, and eyelashes in particular, over their whole length from their base towards their end, one of the sides of the blade 6 tangentially touching the lashes. After the product has been applied to the lashes, the application device 1 is optionally turned around and the lashes are combed by means of the comb 114 so as to separate the lashes which may have stuck together during the application.

FIG. 14B illustrates a sectional view of the block 107 of the product. In this embodiment the bottom 115 of the compartment 108 is curved, which gives the product block 107 the same curved profile. Such a configuration allows better use of the product and makes it possible to take up substantially the whole of the product contained in the compartment while allowing the blade to be charged over substantially its whole width and this over a substantial portion of its length. In other words, because the blade is deformable in a multidirectional mode, and the manner of the take-up, that is to say by placing the blade in a substantially flat manner on the surface of the "cake," the free surface of the cake can be given any profile, in particular concave or convex. If the semi-solid block is formed by a foam block, the convex shape may be obtained by compressing the foam block over its periphery by means of a frame mounted on the compartment 108.

Figure 15:
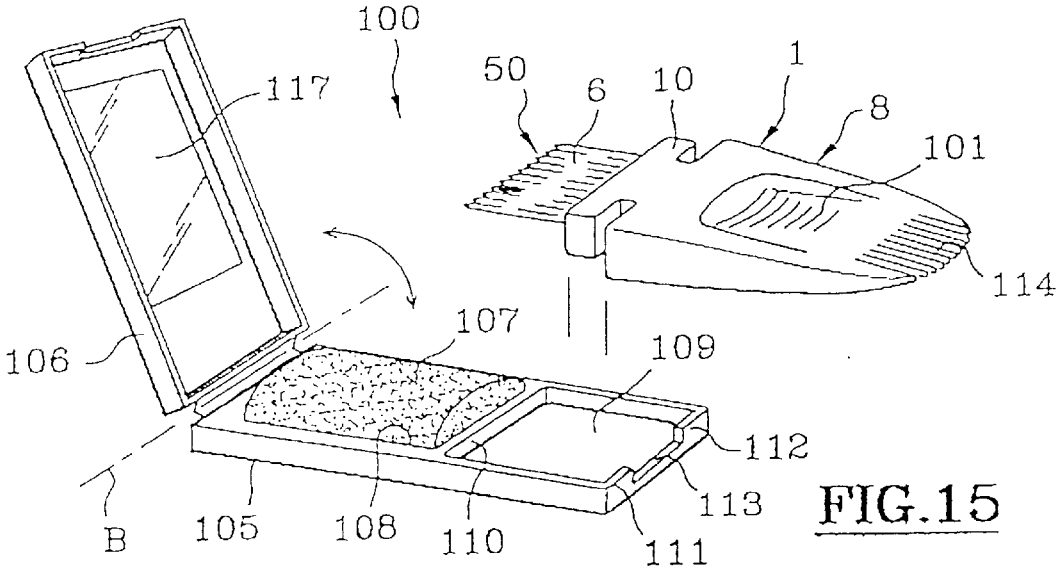

The embodiment of FIG. 15 is a variant of the embodiment of FIGS. 13A to 13C. According to this variant, the lid 106 is articulated on the bottom 105 around an axis of articulation B orientated perpendicularly to the longitudinal axis of the case 100. The articulation is obtained, for example, by means of a film hinge 116. A mirror 117 is mounted on the internal surface of the lid. Such a mirror may be mounted by bonding, welding, catch engagement or riveting. The application device 1 corresponds to that of the preceding embodiment.

Figure 16:
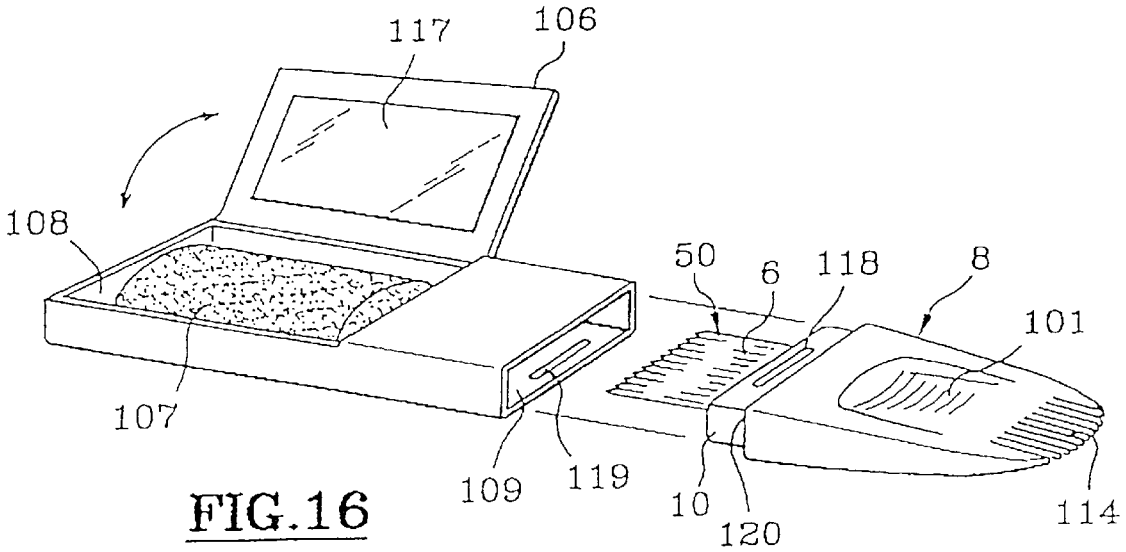

In the embodiment of FIG. 16, the lid 106 is articulated on the bottom 105 by means of a hinge pin parallel to the longitudinal axis of the case. The lid is arranged so as to cover only the compartment 108. The compartment 109, wherein the blade 6 is disposed, forms a parallelepiped casing with a cross-section substantially identical to that of the rest of the case in its closed position. The casing is preferably closed at its end adjacent to the compartment 108. It is open at its other end so as to allow the applicator element 50 to be inserted. For this purpose, the end 10 of the handle 8 carrying the blade 6 has an external cross-section slightly smaller than the internal cross-section of the compartment 109 so as to be capable of sliding in the casing. Ribs 118 provided on one and/or the other of the main sides of the part 10 cooperate by catch engagement with corresponding grooves 119 arranged on the internal surface of the casing so as to immobilize the application device in the thus obtained unit. The rest of the application device corresponds to that which has been described with reference to the other embodiments. In the mounted position, the edge 120 of the handle 8 adjacent to the portion with the smaller cross-section abuts against the corresponding edge of the compartment 109.

Figure 17A:
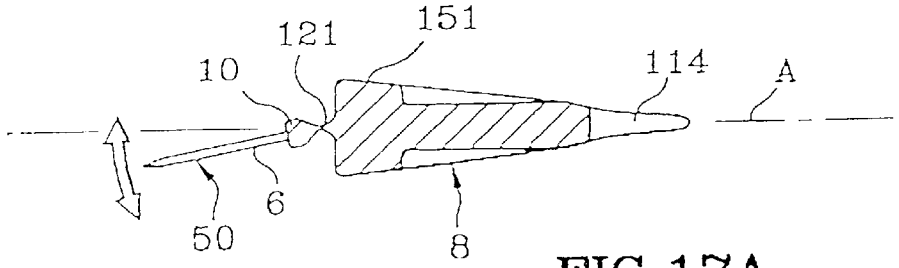
Figure 17B:
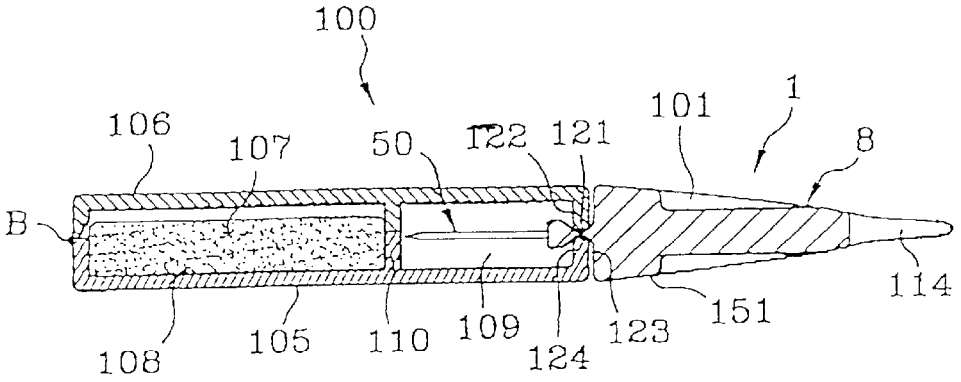

In the embodiment of FIGS. 17A and 17B, the application device 1 differs from that of the preceding embodiments in that the end part 10 carrying the applicator element 50 is articulated relative to the rest 151 of the handle 8. According to an advantageous embodiment, the articulation is formed by a film hinge 121 in the median plane of the application device 1 and is orientated perpendicularly to the axis A of the application device 1. This permits an inclination of the applicator element 50 relative to the axis of the handle which improves the action. This makes it possible to improve the dosing of the product on the applicator element and to facilitate the application of the product on the eyelashes, thus imparting greater comfort and greater precision to the application. Yet other means can be used for obtaining such an articulation, By way of example, the articulation is obtained by means of a profiled section, (one part is articulated on a cylinder carried by the other part). Alternatively, the handle is made of an elastomeric material to give it flexibility favorable to the take-up and application of the product.

As illustrated in FIG. 17B, the lid 106 is articulated on the bottom 105 around a hinge pin B situated on the opposite side to the application device 1. By closing the lid 106 on the bottom 105, the free edge 122 of the lid 106 comes to bear on the film hinge 121, the applicator element 50 being disposed inside the compartment 109 and separated from the product 107 by the partition 110. The edge 123 of the part 151 of the handle 8 situated outside the case 100 substantially abuts against the free edge 122 of the lid 106 and against an edge portion 124 formed by the bottom 105. Thus mounted, the application device is immobilized both axially and in the median plane which it defines. The general form of the unit thus obtained is substantially identical with that described with reference to the other embodiments.

According to another characteristic of the invention, not shown, the application device may comprise a second applicator element, for example instead of the comb, or disposed inside the handle head-to-tail relative to the first element. Alternatively, the handle is detachable from the blade, which permits a selective use of one or the other of the blades for the application and/or the combing of the keratinous fibers. The second blade may be contained either inside the handle or inside a second compartment provided in the case. This second applicator element 50 may have various reliefs, or may have been subjected to a processing different from that of the first applicator element, with a view to introducing still more variability into the make-up. By way of a further variant, the second applicator element is a "liner".

In the preceding detailed description, reference has been made to preferred embodiments of the invention. It is obvious that variants may be introduced into them without departing from the spirit of the invention, such as claimed below.

What is claimed is:

1. A device for applying a make-up product for eyelashes, comprising:

a substantially flat handle;

an applicator element having a free end and being mounted to a first end of said handle, said applicator element being formed by a blade defining a unitary structure elastically deformable in at least two orthogonal directions and disposed substantially parallel to a plane of the handle, wherein said blade has two main sides, wherein a width of said free end, measured along a first one of said orthogonal directions which is parallel to said plane, is at least equal to a quarter of an average width of an arc of the eyelashes to which the make-up product is to be applied; and reliefs formed on a surface of at least one of the main sides and being capable of retaining some of the product after a substantial portion of said surface has been brought into contact with the product.

2. An application device according to claim 1, wherein the width is from 0.75 cm to 3 cm.

3. An application device according to claim 1, wherein the free end of the applicator element has a thickness, measured along a direction perpendicular to said plane, which is no greater than the thickness of said first end of the handle.

4. An application device according to claim 3, wherein said blade has a length, along a second one of said orthogonal directions, ranging from 10 mm to 60 mm.

5. An application device according to claim 4, wherein said length ranges from 10 mm to 30 mm.

6. A device according to claim 1, wherein said elastically deformable material has a hardness in the range of 10 Shore A to 90 Shore D.

7. A device according to claim 1, wherein said applicator element is formed of an elastomeric material chosen from the group of elastomers consisting of polyethylene, polyurethane, polyester, polyether block amides, polyvinyls, terpolymers of ethylene, of propylene and of a diene (EPDM), sequenced polymers of styrene-butadiene (SEBS-SIS), silicone, nitrile and butyl.

8. A device according to claim 1, wherein said blade has prongs at said free end for separating the eylashes after application of the product thereto.

9. A device according to claim 4, wherein the applicator element is formed of at least one block of foam having one of open cells, half-open cells and closed cells.

10. A device according to claim 9, wherein said foam is a foam of one of polyurethane, polyethylene, polyvinyl chloride, polyether, natural rubber and synthetic rubber.

11. A device according to claim 9, wherein said applicator element has an elastically deformable core sandwiched between two foam blocks.

12. A device according to claim 11, wherein the elastically deformable core has a length along the second one of said orthogonal directions greater than the length of the foam blocks between which it is sandwiched, and wherein said core has, adjacent the free end of the applicator element, prongs capable of separating the eyelashes after application of the product.

13. A device according to claim 9, wherein the reliefs are formed by an embossed finish orientated along the second one of said orthogonal directions, said embossed finish being obtained by one of pressing the foam and longitudinal welds.

14. A device according to claim 1, wherein said reliefs are formed by one of grooves, striations, openings passing through at least a part of the thickness of the blade, a flocked coating diamond-shaped bosses, grooves and hollows.

15. A device according to claim 1, wherein said applicator element has a flocked coating over at least a portion of at least one of said main sides.

16. A device according to claim 15, wherein the flocked coating has a mixture of bristles of different characteristics.

17. A device according to claim 1 claim, wherein said free end of the applicator element has a beveled concave shape.

18. A device according to claim 1, wherein an end of the handle opposite to said first end comprises means for separating the eyelashes after application of the product.

19. A device according to claim 18, wherein said separating means comprises a comb.

20. A device according to claim 1, wherein said applicator element is mounted on the first end of the handle by one of bonding and duplex injection molding together with the handle.

21. A device according to claim 1, wherein the handle has an axially curved profile, the blade being disposed along a curve substantially identical with the curve of the handle.

22. A device according to claim 1, wherein the handle comprises two parts articulated around an articulation parallel to said first one of said orthogonal directions.

23. An application device according to claim 4, wherein said length ranges from 15 mm to 20 mm.

24. A device according to claim 1, wherein said elastically deformable material has a hardness in the range of 30 Shore A to 60 Shore D.

25. A device according to claim 15, wherein the flocked coating has a mixture of bristles of different diameters.

26. A device according to claim 25, wherein the flocked coating has a mixture of bristles of different kinds.

27. A device according to claim 26, wherein the flocked coating has a mixture of bristles of different lengths.

28. A device according to claim 27, wherein the flocked coating has a mixture of bristles of different hardnesses.

29. A device according to claim 1 claim, wherein said free end of the applicator element has a beveled convex shape.

* * * * *